US005330048A

United States Patent [19]

Haber et al.

[11] Patent Number: 5,330,048

[45] Date of Patent: Jul. 19, 1994

[54] CONTROLLED ACCESS MIXING VIAL

[75] Inventors: Terry M. Haber, Lake Forest; William H. Smedley, Lake Elsinore; Clark B. Foster, Laguna Niguel, all of Calif.

[73] Assignee: Habley Medical Technology Corporation, Laguna Hills, Calif.

[21] Appl. No.: 89,456

[22] Filed: Jul. 9, 1993

[51] Int. Cl.[5] ..... B65D 25/08

[52] U.S. Cl. ..... 206/221; 209/219; 604/203; 604/87; 215/DIG. 8

[58] Field of Search ..... 206/63.5, 219, 221; 215/DIG. 8; 604/87, 89, 203, 416; 222/52, 386, 522, 523; 366/129, 130

[56] References Cited

U.S. PATENT DOCUMENTS

| | | | |
|---|---|---|---|
| 2,665,690 | 1/1954 | Lockhart . | |
| 3,314,563 | 4/1967 | Mounier . | |
| 3,563,415 | 2/1971 | Ogle . | |
| 3,809,225 | 5/1974 | Allet-Coche . | |
| 4,031,892 | 6/1977 | Hurschman . | |
| 4,781,679 | 11/1988 | Larkin . | |
| 4,982,875 | 1/1991 | Pozzi et al. | 604/87 |
| 5,114,411 | 5/1992 | Haber et al. | 604/203 |
| 5,158,546 | 10/1992 | Haber et al. | 604/89 |
| 5,188,615 | 2/1993 | Haber et al. | 604/203 |
| 5,211,285 | 5/1993 | Haber et al. | 206/221 |
| 5,220,948 | 6/1993 | Haber et al. | 604/211 |
| 5,240,322 | 8/1993 | Haber et al. | 206/221 |
| 5,240,323 | 8/1993 | Haber et al. | 206/221 |

*Primary Examiner*—David T. Fidei
*Attorney, Agent, or Firm*—Townsend & Townsend Khourie & Crew

[57] ABSTRACT

A controlled access mixing vial (2) includes a cylindrical mixing container (8) having a fixed septum (14) at its outer end (10) and a breachable seal (22) at its inner end (12). A first pharmaceutical (52) is housed within the mixing container between the seal and the septum. A supplemental container (4) is coaxially translatably mounted to the mixing container and contains a second pharmaceutical (50) between the mixing and supplemental containers. Collapsing the mixing and supplemental containers from a pre-mixed condition to a post-mixed condition, preferably with a chosen rotary movement (128, 130) using threads (60, 62), causes the breachable seal to open permitting the second pharmaceutical to be driven into the mixing container. Movement to the post-mixed condition dislodges a safety shield (100) to permit access to the septum. Rotary locks (116, 118, 120) limit movement from the pre-mixed condition except with the chosen rotary movement and prevents all movement from the post-mixed condition.

15 Claims, 4 Drawing Sheets

CONTROLLED ACCESS MIXING VIAL

CROSS-REFERENCE TO RELATED APPLICATIONS

This application is related to the following U.S. Pat. Nos. 5,114,411 issued May 19, 1992 for Multi-Chamber Vial; No. 5,158,546 issued Oct. 27, 1992 for Controlled Action Self-Mixing Vial; U.S. Pat. No. 5,188,615 issued Feb. 23, 1993 for Mixing Vial; and U.S. Pat. No. 5,220,948 issued Jun. 22, 1993 for Precision Syringe-Filling Mechanism, the disclosures of which are incorporated by reference. This application is also related to the following U.S. Patent Application No. 07/741,777 filed Aug. 7, 1991 for Syringe Filling and Metering Device for Pharmaceutical Containers, the disclosure of which is incorporated by reference.

BACKGROUND OF THE INVENTION

Safe and effective drug therapy by injection depends not only upon accurate diagnosis, but also on efficient and reliable introduction of the medical substance into the subcutaneous cellular tissue without introducing contaminants or ambient air. The applicable drug or pharmaceutical must first be drawn from the resident container or vial into a syringe before injection. The integrity and features of the vial, therefore, are influential over the overall safety of the injection.

Problems associated with injections are complicated when the medication to be administered must be stored as two separate component parts, then mixed, prior to injection. Dual chamber vials have been developed to facilitate storage and mixing of these two-component medications. Common examples of multipart medications include medications which must be mixed from a component A, usually a preservative or catalyst, and a component B, which is usually a pharmaceutical. Component A or component B may be in powder or crystalline form instead of liquid form.

Dual chamber vials have been developed which allow an A component and a B component to remain separated in independent chambers within a single package until mixing is desired. The vial allows mixing of the component parts in that same unitary package. In an example of such a device is the MIX-VIAL two compartment vial manufactured by the Upjohn Company of Kalamazoo, Mich. This device is a single vial container having two chambers separated by a small stopper. The septum is formed by a plunger-stopper at one end which is used to pressurize the contents of one chamber so to displace a plug lodged in a small orifice separating the two chambers. As the plunger stopper is displaced (by giving it an axial push), the plug floats freely into one of the chambers and is used as an agitator to mix the two component parts together. The two components are free to flow between chambers through the connecting orifice and thereby mix together.

Pharmaceutical components are sometimes sensitive to how violently they are mixed. For example, certain lyophilized crystals of human growth hormone, when mixed with a liquid carrier, must be mixed slowly. Mixing too quickly can cause damage to the pharmaceutical. The mechanical crushing, shearing and tearing, which can accompany rapid mixing, break up the molecules into subcomponents which do not retain the same medical qualities.

SUMMARY OF THE INVENTION

The present invention is directed to a controlled access self-mixing vial which can be used with a conventional syringe or a multiple-dose syringe to permit the controlled mixing of two pharmaceutical components or pharmaceuticals and the aspiration or delivery of the mixed pharmaceutical into the syringe is a simple, safe and effective manner.

The controlled access mixing vial is used to mix two pharmaceutical components, at least one being liquid, in a controlled fashion for subsequent aspiration into a syringe. The vial includes an elongated mixing chamber having a fixed septum at the first or outer end of the mixing container. A fluid pressure rupturable seal is positioned at the second or inner end of the mixing container. One pharmaceutical component is stored within a mixing region within the mixing container between the seal and the septum.

An axially translating supplemental container is mounted over the inner end of the mixing container. A variable volume region is defined between the mixing and supplemental containers; a second pharmaceutical component is stored within the variable volume region. Collapsing the mixing and supplemental containers causes the rupturable seal to open permitting the second component within the variable volume region (which is a liquid) to be driven into the mixing region to mix with the first component (which can be a liquid or a slurry or a solid). This creates an overpressure within the mixing region. This overpressure aids withdrawal of the mixed pharmaceutical into the syringe.

This collapsing of the mixing and supplemental containers is accomplished in a controlled, preferably slow, manner by threadably coupling the two containers. That is, threads associated with the mixing and supplemental containers are used to axially drive the containers towards one another so that the mixing occurs in a controlled manner. Other driving structure, such as an axial ratchet drive, could be used instead of the threaded drive.

The containers are preferably coupled in a manner so that the movement of the driving structure can only occur from the initial (pre-mixed) rotary orientation towards the final (post-mixed) rotary orientation; once in the final rotary orientation, any relative rotary movement of the driving structure (and thus relative axial movement of the containers) is prevented.

A safety shield is used to cover the fixed septum when the vial is in the pre-mixed condition. This prevents unauthorized needle access to the interior of the vial through the septum. The safety shield is removable from the vial when in the post-mixed condition. The vial also preferably includes a user-manipulable septum shield which can be moved to cover and uncover the septum after mixing.

Other features and advantages of the invention will appear from the following description in which the preferred embodiment has been set forth in detail in conjunction with the accompanying drawings.

DESCRIPTION OF THE PREFERRED EMBODIMENT

Figure 1:
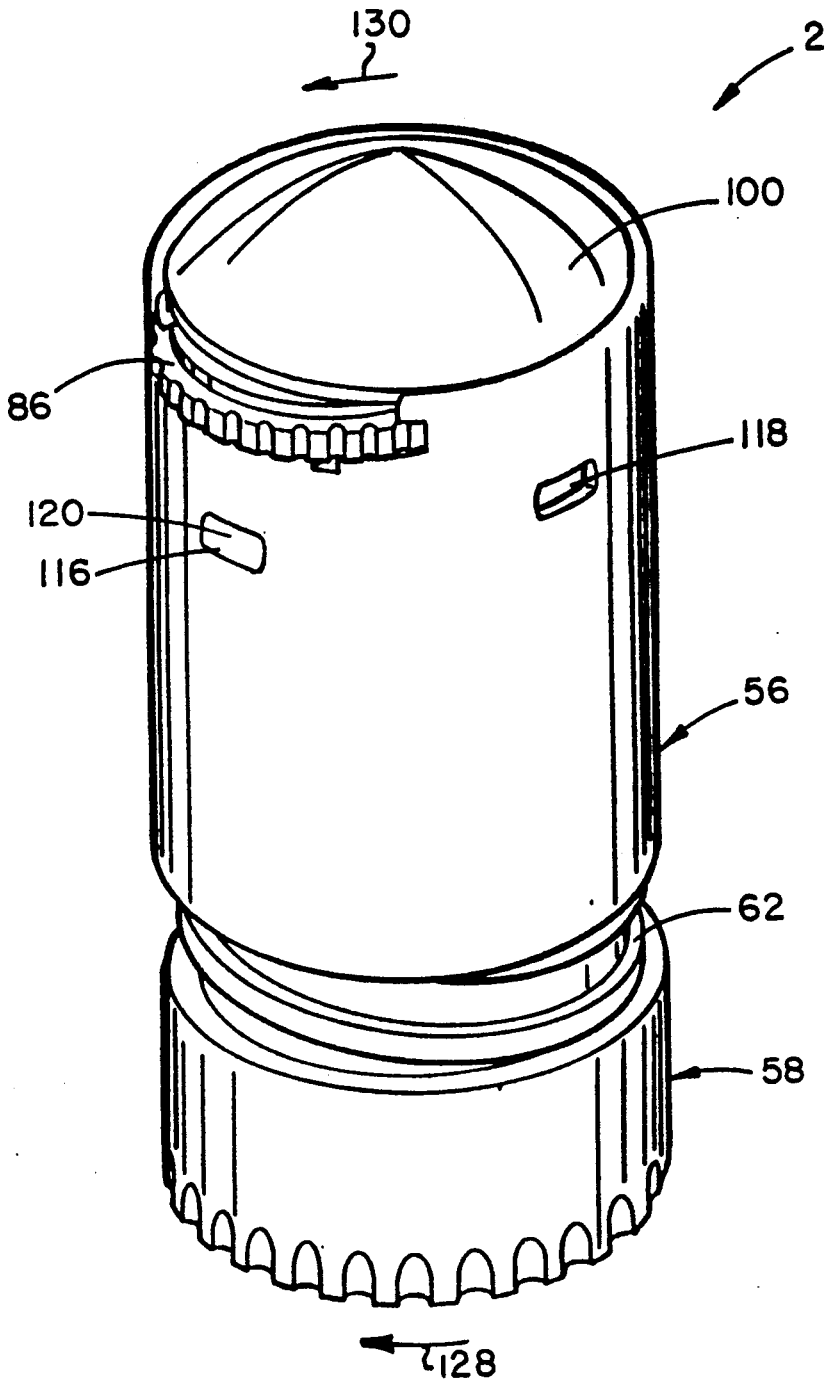
FIG. 1 is an isometric view of a controlled access mixing vial made according to the invention.
Figure 2:
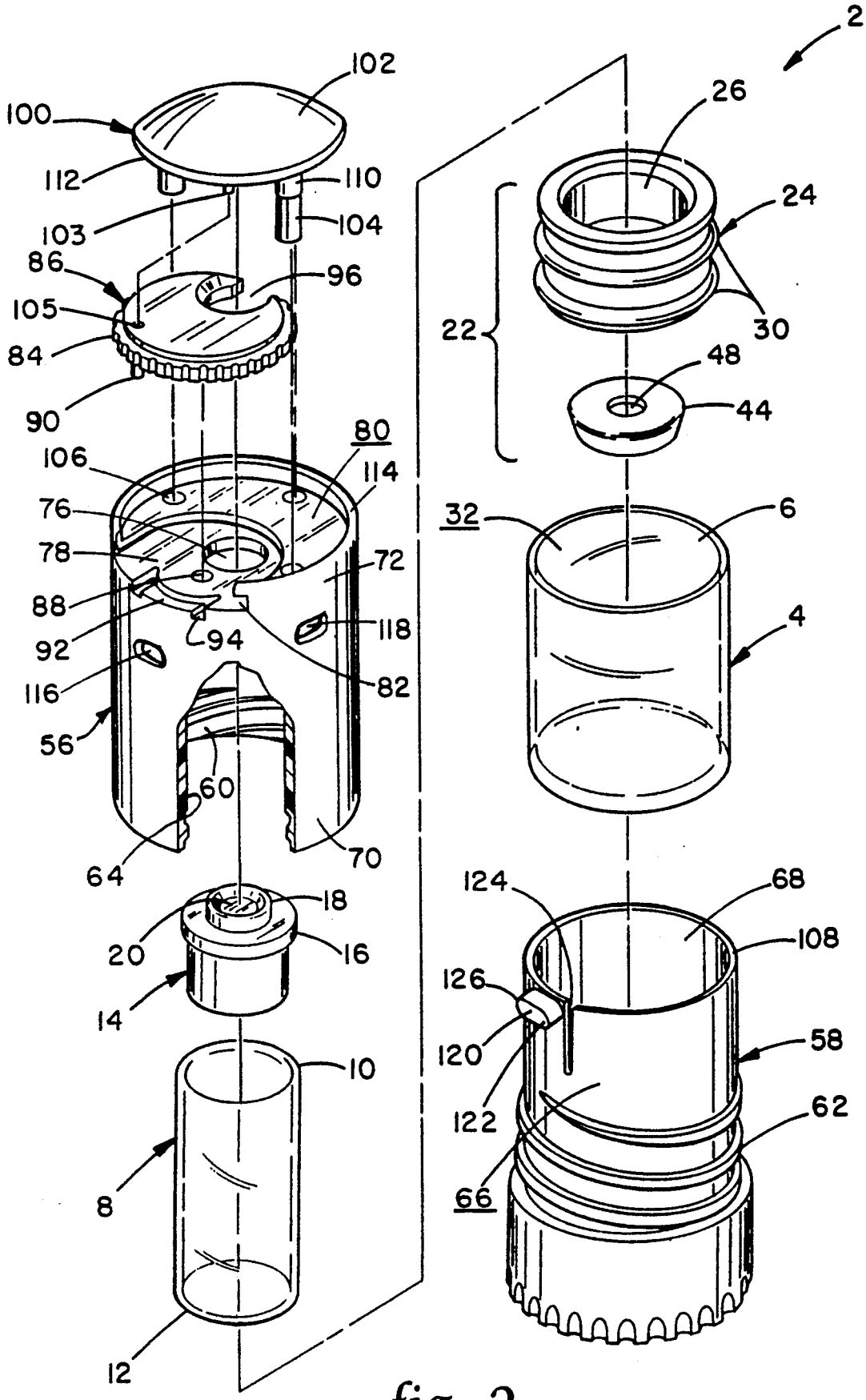
FIG. 2 is an exploded isometric view of the mixing vial of FIG. 1.
Figure 3:
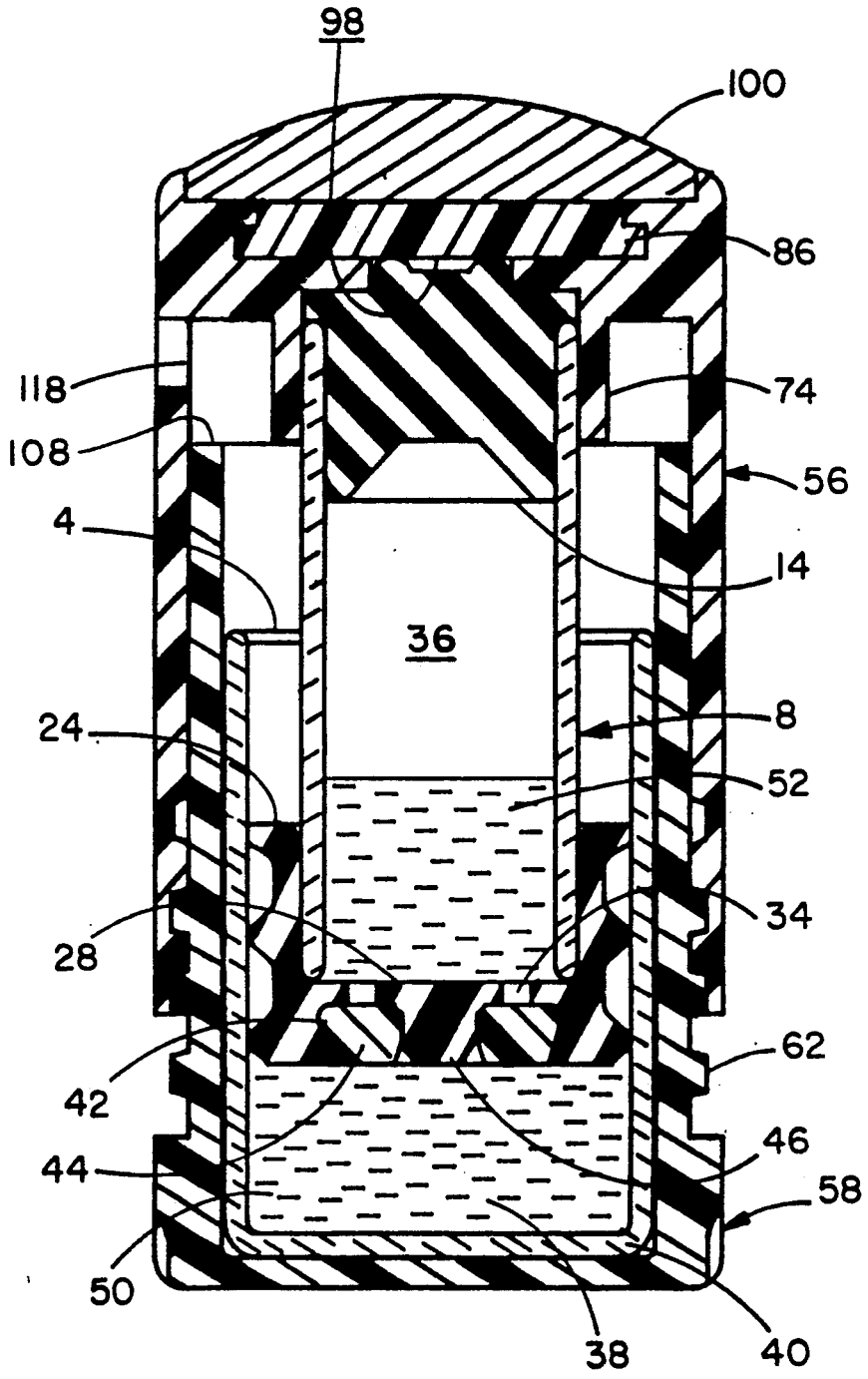
FIG. 3 is a cross-sectional view of the mixing vial of FIG. 1 in a pre-mixed condition.

FIGS. 1–3 illustrate a controlled access mixing vial 2. Vial 2 includes a cup-shaped, typically glass, supplemental container 4 having an open end 6, and a generally cylindrical mixing container 8, also made of glass, having an open first or outer end 10 and an open second or inner end 12. First end 10 is sealed by a fixed septum 14 having an outer lip 16 which rests against first end 10 of mixing container 8. An outwardly extending rim 18 surrounds a central, needle pierceable portion of septum 14.

Figure 3A:
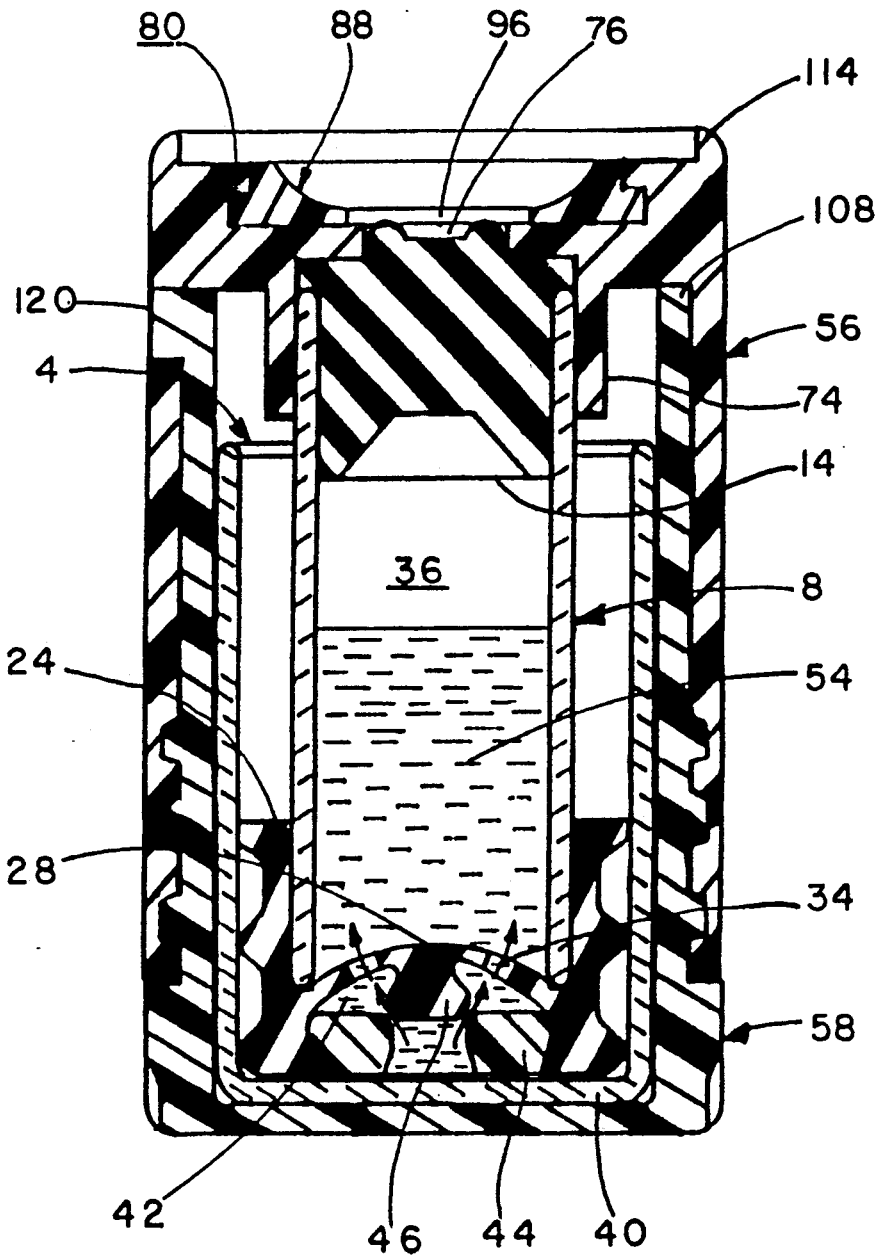
FIG. 3A illustrates the mixing vial of FIG. 3 after the mixing and supplemental containers have been collapsed, placing the mixing vial in a post-mixed condition by screwing the two containers together, thereby mixing the pharmaceuticals in a relatively slow, controlled manner.

Second end 12 of container 8 is covered by a breachable seal 22. Seal 22 includes an elastomeric piston member 24 having a hollow interior 26 and an end 28 which lies against second end 12 of container 8. Piston member 24 has a number of outwardly extending ribs 30 which are sized to sealably engage the inner circumferential surface 32 of supplemental container 4 as shown in FIG. 3. End 28 of piston member 24 has a number of through holes 34 which permit fluid communication between a mixing region 36 defined within mixing container 8 between septum 14 and piston member 24, and a variable volume region 38 defined within supplemental container 4 between a closed end 40 of container 4 and piston member 24. Through holes 34 are, however, intersected by an annular recess 42 having outwardly narrowing side walls. Breachable seal 22 includes a valve insert 44, made of a hard plastic such as polycarbonate, sized to fit into annular recess 42. Collapsing of mixing container 8 into supplemental container 4, in the manner to be discussed below, raises the pressure within variable volume region 38 and thus causes the center portion 46 of end 28 of piston member 24 to be dislodged from within the center opening 48 in valve element 44 as shown in FIG. 3A. This permits flow of a second pharmaceutical 50 within variable volume region through annular recess 42 between center portion 46 and valve insert 44, through through holes 34 and into mixing region 36 where second pharmaceutical 50 mixes with a first pharmaceutical 52 to create a mixed pharmaceutical 54.

This movement of vial 2 from the pre-mixed condition of FIG. 3 to the post-mixed condition of FIG. 3A is accomplished with the use of upper and lower housings 56, 58. Upper and lower housings 56, 58 have internal and external threads 60, 62 formed on their inner and outer surfaces 64, 66, respectively. The interior 68 of lower housing 58 is sized to accommodate supplemental container 4. Upper housing 56 has an open lower end 70 at which threads 60 are formed. Upper housing 56 has a substantially closed upper end 72 with an inner, cylindrical extension 74, see FIG. 3, centered on a central opening 76 formed in upper end 72 of upper housing 56. Cylindrical extension 74 is sized to accept outer end 10 of mixing container 8 with rim 18 of septum 14 extending through central opening 76.

Upper end 72 has a U-shaped cut-out 78 formed in the upper surface 80 of end 72. Cut-out 78 is circumscribed by a U-shaped undercut 82 sized to accept the reduced thickness, outer periphery 84 of a thumb wheel 86. Thumb wheel 86 has a centrally located pivot pin, not shown, which fits within a pivot hole 88 formed in upper surface 80 to permit thumb wheel 86 to rotate about pivot hole 88. The rotary movement of thumb wheel 86 is limited by a limit pin 90, carried by thumb wheel 86 adjacent its periphery 84, engaging the ends of an arcuate cut-out 92 formed in end 72 beneath U-shaped cut-out 78. Limit pin 90 is sized to engage end recesses 94 at either end of arcuate cut-out 92 so to act as detents to keep thumb wheel 86 at a septum exposed position (see FIG. 3A) or a septum covered position (see FIG. 3). The septum exposed position occurs when a U-shaped cut-out 96 in thumb wheel 86 is aligned with central opening 76. Rotational movement of thumb wheel 86 reorients cut-out 96 so that it no longer overlies central opening 76 but rather covers central opening 76 as well as rim 18 and central portion 20 of septum 14. As suggested in FIG. 3, the lower surface 98 of thumb wheel 86 presses against the outwardly extending rim 18 of septum 14 thus providing a seal for the septum when so covered. When thumb wheel 86 is in the septum exposed position, central portion 20 of septum 14 is immediately accessible to the user for both preliminary cleaning and for subsequent needle access.

Lower housing 58, upper housing 56 and thumb wheel 86 are preferably made from a hard plastic such as polycarbonate. Safety shield 100 is preferably made from aluminum and is used to prevent inadvertent or unauthorized needle access to the interior of vial 2 prior to mixing. Safety shield 100 includes a dome-shaped body 102, a thumb wheel locking pin 103 and three mounting pins 104. Pin 103 is positioned to engage a complementary hole 105 in thumb wheel 86 so to lock thumb wheel 86 in the septum-covered position of FIG. 3. Mounting pins 104 are sized and positioned to engage mounting holes 106 formed in upper end 72 of upper housing 56. Pins 104 engage the upper edge 108 of lower housing 58 when upper and lower housing 56, 58 are rotated relative to one another thus causing mixing container 8 to move into supplemental container 4 thus driving first pharmaceutical 50 into second pharmaceutical 52 to create mixed pharmaceutical 54 as illustrated in FIG. 3A. Doing so forces safety shield 100 away from upper end 72 of upper housing 56 so that pin 103 is disengaged from hole 105 and to allow safety shield 100 to be removed by the user. Prior to being so displaced, safety shield 100 is securely mounted to upper housing 56 through the snug frictional engagement of the upper portions 110 (which have slightly larger diameters than the rest of mounting pins 104) within mounting holes 106 and the outer edge 112 of safety shield 100 within the outwardly extending rim 114 of upper end 72 of upper housing 56. This arrangement helps prevent unauthorized removal of safety shield 102 prior to mixing of the contents of vial 2.

Another aspect of the invention is the control of movement of vial 2 from the premixed condition of FIG. 3 to the post-mixed condition of FIG. 3A. To do so, the present invention uses a pair of openings 116, 118 formed in upper housing 56 and a radially extending lug 120 extending from lower housing 58 adjacent upper edge 108. One end 122 of lug 120 lies adjacent an axial slot 124 formed in lower housing 58 and extending from upper edge 108. Axial slot 124 permits lug 120 to be biased radially inwardly when housed within opening 116 as upper and lower housings 56, 58 are rotated relative to one another using left-hand threads 60, 62. This rotation is suggested by arrows 128, 130 in FIG. 1. This flexing of upper edge 108 is aided by a slight ramping of the other end 126 of lug 120. However, since there is only a single slot 124 adjacent lug 120, it is not possible to uncouple upper and lower housings 56, 58 from one another by rotating the housings in the opposite rotary directions, which would tend to separate the two. This further helps to prevent unauthorized disassembly of or tampering with vial 2 prior to mixing.

After rotating upper and lower housings 56, 58 in the directions of arrows 128, 130 (about 270° in the preferred embodiment) so to collapse the housings into one another from the pre-mixed condition of FIG. 3 to the post-mixed condition of FIG. 3A, lug 120 enters opening 118. Due to the location of axial slot 124 adjacent one end 122 of lug 120, lug 120 does not naturally become disengaged from opening 118 if one were to try to rotate housings 56, 58 in the directions opposite arrows 128, 130; such movement is prevented by the engagement of lug 120 within opening 118 just as similar movement was resisted by the engagement of lug 120 within opening 116. Instead of having a single lug and two openings, the invention could use two lugs and a single opening, appropriately configured, to provide the desired limited relative rotary movement between housings 56, 58. Other types of rotary movement limiting structure could be used as well.

In use, vial 2, in the pre-mixed condition of FIG. 3, is grasped by the user and rotated in the directions of arrows 128, 130 so that housings 56, 58 are collapsed into one another by the engagement of left-hand threads 60, 62. Right-hand threads could, of course, be used as well. Doing so causes mixing container 8 and breachable seal 22 therewith to be driven into supplemental container 4 which deflects central portion 46 of end 28 of piston member 24 to the position of FIG. 3A thus opening up a fluid pathway between variable volume region 38 and mixing region 36. This causes second pharmaceutical 50 to be driven into mixing region 36 to be combined with first pharmaceutical 52 to create mixed pharmaceutical 54 of FIG. 3A. This movement also causes pin 103 to be dislodged from hole 105, thus releasing thumb wheel 86. The axial movement of safety shield 100 also forces mounting pins 104 out of mounting holes 106 by the axial movement of rim 114 at upper end 72 of upper housing 56. The user can then remove and, if desired, discard safety shield 100. Thumb wheel 86 is then moved from its septum covered position of FIG. 3 to its septum exposed position of FIG. 3A with U-shaped cut-out 96 overlying central opening 76 thus exposing central portion 20 of septum 14. Central portion 20 can then be swabbed or wiped with alcohol or other disinfectant prior to use. The user then inverts vial 2, inserts the needle cannula of a syringe (not shown) through central portion 20 of septum 14 and withdraws the appropriate amount of mixed pharmaceutical 54 from the vial. It should be noted that there is an overpressure within mixing region 36 so that the initial withdrawal of mixed pharmaceutical 54 will take place automatically once the needle cannula is inserted into mixing region 36. After the desired quantity of mixed pharmaceutical 54 is removed, thumb wheel 86 can be returned to the septum covered position to help keep central portion 20 of septum 14 covered and sealed.

Modification and variation can be made to the disclosed embodiment without departing from the subject of the invention as defined in the following claims. For example, other types of breachable seals could be used instead of seal 22. Seal 22 could be made to include a frangible portion which ruptures upon exertion of an appropriate fluid pressure. The breachable seal could use tethered or untethered plugs which pop out of openings formed in the seal upon exertion of fluid pressure. The breachable seal could also be breached using mechanical force rather than fluid pressure. Safety shield 100 could be pivotably mounted to upper housing. Threads 62 could be integrally formed on supplemental container 4.

What is claimed is:

1. A controlled access mixing vial, for use with first and second pharmaceutical components, the second component being a liquid component, comprising:

a mixing container having first and second ends with openings at the first and second ends;

a septum mounted to and sealing the first end of the mixing container;

a breachable seal at the opening at the second end of the mixing container, the first component being within a mixing region between the seal and the septum;

a supplemental container;

the mixing and supplemental containers being coaxially translating containers with the second end of the mixing container sealably positioned within the supplemental container, the second component being within a variable volume region defined by the mixing and supplemental containers;

a first rotary drive element associated with and covering the first end of the mixing container;

a second rotary drive element associated with the supplemental container;

thread means for rotationally coupling the first and second rotary drive elements so that rotating the first and second drive elements in a first rotary direction from an initial rotary orientation to a final rotary orientation drives the mixing container into the supplemental container from a pre-mixed condition to a post-mixed condition to force the second component past the breachable seal and into the mixing region causing the first and second components to mix to create a mixed pharmaceutical;

a first rotary lock operably coupling the first and second rotary drive elements when in the initial rotary orientation and preventing rotary movement except in the first rotary direction when in the initial rotary orientation; and a second rotary lock operably coupling the first and second drive elements when in the final rotary orientation and preventing any relative rotary movement therebetween when in the final rotary orientation.

2. The vial of claim 1 wherein the first rotary drive element includes a first housing having a central opening opposite the septum.

3. The vial of claim 2 further comprising:

a safety shield mounted to the first housing and covering the central opening; and means for automatically dislodging the safety shield from covering the central opening upon movement of the mixing and supplemental containers to the post-mixed condition so to provide user access to the portion of the septum.

4. The vial of claim 2 wherein the septum includes a portion sized and positioned to lie within the central opening.

5. The vial of claim 4 wherein the portion of the septum includes a rim extending through the opening.

6. The vial of claim 5 further comprising a user-actuated septum shield movably mounted to the first housing for movement between a septum-exposed position and a septum-covered position, the rim of the septum contacting the septum shield when the shield is at the septum-covered position.

7. The vial of claim 6 wherein the septum shield is disk-shaped element rotatably mounted to the first housing.

8. The vial of claim 7 wherein the septum shield includes a cut-out which overlies the central opening when in the septum-exposed position.

9. The vial of claim 2 wherein the second rotary drive element includes a cup-shaped second housing within which the supplemental container is housed.

10. The vial of claim 1 wherein the breachable seal includes a resilient member having a through-bore, a recess in fluid communication with the through-bore and a valve insert positionable within the recess.

11. The vial of claim 1 wherein the first and second rotary locks include at least one opening associated with one of the first and second rotary drive elements, and at least one projection associated with the other of the first and second rotary drive elements and located to engage the at least one opening at one of the initial and final rotary orientations.

12. The vial of claim 11 wherein the rotary lock associated with said at least one projection includes means for resiliently biasing said projection into engagement with said at least one opening.

13. The vial of claim 1 wherein the first and second rotary locks include opening and projection means carried by the first and second rotary drive elements.

14. The vial of claim 1, wherein the mixing container is cylindrical and the supplemental container is cup shaped.

15. A controlled access mixing vial, for use with first and second pharmaceutical components, the second component being a liquid component, comprising:

a mixing container having first and second ends with openings at the first and second ends;

a septum mounted to and sealing the first end of the mixing container;

a breachable seal at the opening at the second end of the mixing container, the first component being within a mixing region between the seal and the septum;

a supplemental container;

the mixing and supplemental containers being coaxially translating containers with the second end of the mixing container sealably positioned within the supplemental container, the second component being within a variable volume region defined by the mixing and supplemental containers;

a first rotary drive element associated with and covering the first end of the mixing container, the first rotary drive element including a first housing having a central opening opposite the septurn;

a second rotary drive element associated with the supplemental container;

thread means for rotationally coupling the first and second rotary drive elements so that rotating the first and second drive elements in a first rotary direction from an initial rotary orientation to a final rotary orientation drives the mixing container into the supplemental container from a pre-mixed condition to a post-mixed condition to force the second component past the breachable seal and into the mixing region causing the first and second components to mix to create a mixed pharmaceutical;

a first rotary lock operably coupling the first and second rotary drive elements when in the initial rotary orientation and preventing rotary movement except in the first rotary direction when in the initial rotary orientation; and a second rotary lock operably coupling the first and second drive elements when in the final rotary orientation and preventing any relative rotary movement therebetween when in the final rotary orientation;

a safety shield mounted to the first housing and covering the central opening;

means for automatically dislodging the safety shield from covering the central opening upon movement of the mixing and supplemental containers to the post-mixed condition so to provide user access to the portion of the septurn; and a user-actuated septurn shield movably mounted to the first housing for movement between a septurn-exposed position and a septurn-covered position, the septurn shield including a cut-out which overlies the central opening when in the septurn-exposed position.

* * * * *